United States Patent [19]

Berlin et al.

[11] 4,055,192

[45] Oct. 25, 1977

[54] RECOVERY OF REUSABLE TOBACCO PARTICLES IN MACHINES FOR THE PRODUCTION OF PLAIN AND FILTER TIPPED SMOKERS PRODUCTS

[75] Inventors: Herbert Berlin; Siegfried Abrahams; Peter Brand, all of Hamburg, Germany

[73] Assignee: Hauni-Werke Körber & Co. KG, Hamburg, Germany

[21] Appl. No.: 515,440

[22] Filed: Oct. 16, 1974

[30] Foreign Application Priority Data

Nov. 28, 1973 Germany ..... 2359193

[51] Int. Cl.[2] ..... A24C 5/18; A24B 7/14

[52] U.S. Cl. ..... 131/84 B; 131/110

[58] Field of Search ..... 131/110, 96, 84 R, 84 B, 131/84 C, 58, 61 R, 61 A, 61 B, 71, 72, 88, 21 R, 21 B, 21 C, 21 D, 23 A, 21 A; 198/20 C

[56] References Cited

U.S. PATENT DOCUMENTS

| | | | |
|---|---|---|---|
| 3,026,878 | 3/1962 | Eissmann | 131/110 X |
| 3,516,418 | 6/1970 | Pechard | 131/96 X |
| 3,665,932 | 5/1972 | Goldbach | 131/110 X |
| 3,901,373 | 8/1975 | Rudzinat | 198/20 C |
| 3,921,644 | 11/1975 | Lohe | 131/21 B |
| 3,955,584 | 5/1976 | Molins et al. | 131/96 |

*Primary Examiner*—Robert W. Michell
*Assistant Examiner*—V. Millin
*Attorney, Agent, or Firm*—Peter K. Kontler; John Kurucz

[57] ABSTRACT

Tobacco particles which escape from plain cigarettes and/or filter cigarettes in machines for the making of plain and filter cigarettes are partially separated from streams of suction air before such streams reach the main separator. This relieves the main separator so that the latter necessitates less frequent cleaning and/or replacement of filters. In a filter cigarette making machine with or without a main separator, one or more separators for reusable tobacco particles can be installed to collect reusable particles which escape at one, two or more stations where the escape of tobacco is likely and pronounced. Such separators employ suction fans, vessels below the respective units, and pipes which convey the contents of vessels to a tobacco removing device upstream of the fans.

13 Claims, 9 Drawing Figures

21
19
22
23
Z
108
109
111
113
112
24
A
107
116b
114b
114a
116a
32a
32
104b
104a
IV
C
129
123
131b
131a
131
116
121b
117b
121a
117a
32b
32c
24a

RECOVERY OF REUSABLE TOBACCO PARTICLES IN MACHINES FOR THE PRODUCTION OF PLAIN AND FILTER TIPPED SMOKERS PRODUCTS

BACKGROUND OF THE INVENTION

The present invention relates to the manufacture of rod-shaped smokers' products in general, and more particularly to improvements in means for recovering reusable and/or non-reusable tobacco particles which leave their intended path during transport through one or more machines for the making of plain or filter tipped cigarettes, cigars or cigarillos.

It is already known to combine a single tobacco processing machine or a group of such machines with a segregating device which serves to remove tobacco particles (particularly reusable tobacco particles) for renewed processing, especially to remove tobacco particles and/or other solid particles from one or more air streams which are used in such machines to attract or transport tobacco particles, wrapped or unwrapped rod-like fillers consisting of tobacco, and/or fillers and filter rod sections. Tobacco particles which escape from their intended path are often small. Thus, and referring by way of example to the manufacture of plain or filter cigarettes, smaller shreds of tobacco leaves whose size may vary within a wide range and includes sizes which are characteristic of tobacco dust are likely to escape during the forming of continuous tobacco filter, during wrapping of the filler in cigarette paper, during severing of the resulting cigarette rod into discrete plain cigarettes (wrapped fillers of finite length), during transport of plain cigarettes into a filter cigarette making machine, during assembly of plain cigarettes with filter rod sections to form filter cigarettes, during testing of filter cigarettes, and during further transport of tested cigarettes to a packing machine. Many units of such machines operate with suction, e.g., one or more rotary drum-shaped conveyors may be provided with flutes which communicate with ports connected to a suction generating device to retain wrapped fillers, filter rod sections and/or filter cigarettes during transport from station to station. Smaller solids which escape during manipulation of comminuted tobacco leaves, unwrapped fillers, wrapped fillers and filter cigarettes often consist of quartz.

All such units of a cigarette making or filter cigarette making machine (or of a complete production line including the just mentioned machines) which operate with suction air are normally connected to a single suction generating device (e.g., a large fan). In many presently known machines or production lines a single device for segregation of tobacco particles and/or other solids which escape during processing of tobacco is installed in the conduit which is connected with the outlet of the suction generating device. The purpose of the segregating device is to prevent the escape of tobacco and/or quartz dust into the atmosphere. It has been found that a single segregating device for solid particles which escape in a cigarette making machine does not suffice to collect all solid particles and that such device is not suited for recovery of reusable tobacco particles except by hand. Also, it has been found that the presently known segregating devices which are used in connection with filter cigarette making machines are quite unsatisfactory, especially as concerns the percentage of recovered solids and also as regards the ease of recycling reusable tobacco particles. Still further, the presently known segregating devices are very sensitive in that they are likely to be clogged with solid particles after a relatively short period of use. The cleaning of or replacement of expandable parts in such segregating devices is time-consuming and necessitates lengthy interruptions in the operation of respectie machines.

SUMMARY OF THE INVENTION

An object of the invention is to provide novel and improved means for segregating solid particles which escape from their intended path in a machine or a group of machines for the processing of tobacco.

Another object of the invention is to provide novel and improved segregating means which can be used in addition to or as a substitute for conventional segregating means.

A further object of the invention is to provide segregating means which can relieve the presently employed segregating means so that the latter requires less frequent inspection, cleaning and/or replacement of filters or analogous parts.

An additional object of the invention is to provide a novel and improved separator for tobacco particles and other solids which escape in a cigarette making machine.

Still another object of the invention is to provide novel and improved separators for reusable and/or other tobacco particles and other solids which escape in a filter cigarette making machine.

An additional object of the invention is to provide a novel and improved separator which can collect at least some tobacco particles and other solid particles escaping in a portion of or in a complete production line, especially in a cigarette making machine and in a filter cigarette making machine which is directly coupled to the cigarette making machine.

A feature of the invention resides in an improvement in apparatus for the manufacture and processing of smokers' products wherein tobacco particles and/or wrapped or unwrapped rod-like tobacco fillers (e.g., plain and filter tipped cigarettes) are transported by conveyors along at least one predetermined path and/or otherwise manipulated at a plurality of stations, wherein the transport and manipulation of particles and fillers is effected at least in part by at least one stream of suction air with attendant unpredictable entry of reusable tobacco particles into the stream, and wherein at least some particles of tobacco are removed from the air stream during passage of the air stream through a first segregating means. The improvement consists in the provision of additional segregating means including at least one separator having means for admitting the stream, means for removing tobacco particles from the thus admitted stream, and means for discharging the stream, for example, into the first segregating means wherein the particles which happen to remain in the stream are removed before the stream is discharged into the atmosphere or reused.

The first segregating means comprises a suction generating device and the discharging means of the separator may be connected to the suction inlet of such device.

The apparatus may comprise a machine for the manufacture of wrapped fillers (e.g., plain cigarettes) and one of the conveyors may include means (e.g., the flutes of a rotary drum-shaped row forming conveyor) for receiving wrapped fillers from the machine and for transporting the wrapped fillers along a portion of the aforementioned path, and means (e.g., suction channels and/or ports) for retaining the fillers in the receiving means by suction. The stream admitting means of the separator then preferably comprises a suction pipe which is connected with the retaining means.

The tobacco particles which are removed from the air stream in the separator of the second segregating means may be fed into a magazine forming part of the customary distributor of the machine for making wrapped tobacco fillers.

If the apparatus further comprises at least one additional machine, e.g., a machine for attaching filter rod sections to wrapped fillers which are produced in the aforementioned machine, the stream admitting means of the separator may comprise at least one first pipe which conveys a first tobacco-containing air stream from the first machine and at least one second pipe which conveys at least one stream of tobacco-containing air from the additional machine.

Another feature of the invention resides in the provision of apparatus for the manufacture of filter tipped smokers' products which comprises a first machine for the production of wrapped rod-like fillers consisting of tobacco particles (such fillers may constitute plain cigarettes of unit length), and a second machine for attaching filter rod sections to the fillers which are produced by the first machine. One of the machines has means for conveying fillers from the first to the second machine and the second machine comprises a plurality of units (these units may include the just mentioned conveying means) wherein the fillers are manipulated prior to, during and subsequent to assembbly with filter rod sections with attendant escape of reusable tobacco particles from certain fillers. The apparatus further comprises suction generating means, conduit means connected to the suction generating means and having inlet means in the region of at least one of the aforementioned units so as to convey at least one stream of air and the reusable tobacco particles from the one unit, and means for segregating tobacco particles from the stream.

The novel featues which are considered as characteristic of the invention are set forth in particular in the appended claims. The improved segregating means itself, however, both as to its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
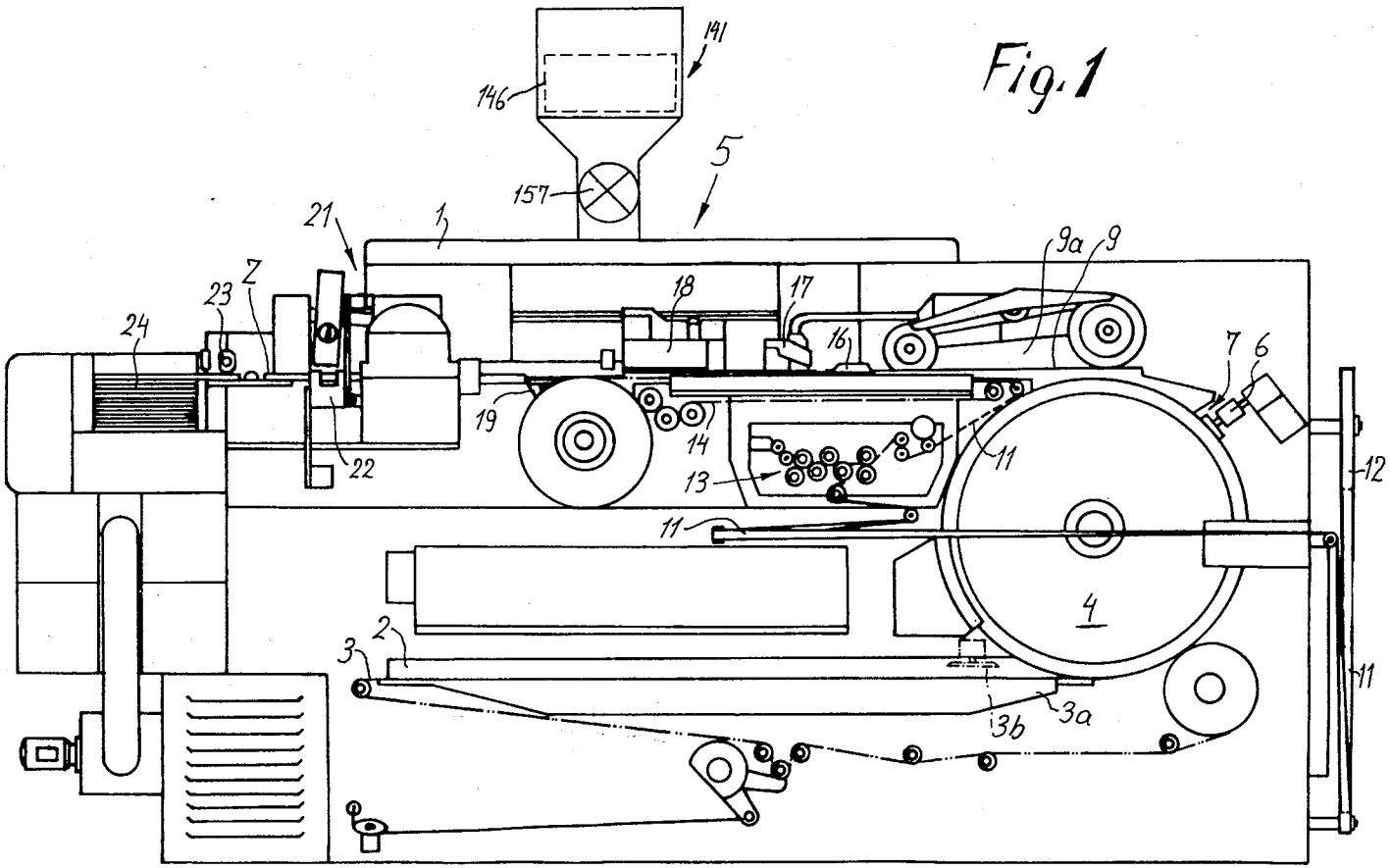
FIG. 1 is a schemaatic elevational view of a machine for the making of wrapped rod-like tobacco fillers with a conveyor from which reusable tobacco particles which escape from certain fillers are returned to a magazine of the machine.

FIG. 1 shows a cigarette rod making machine 5 of the type known as GARANT produced by Hauni-Werke of Hamburg-Bergedorf, Western Germany. This machine comprises a distributor 1 having a magazine (not shown) for a supply of shredded tobacco and means for showering tobacco shreds onto the upper stretch of an elongated conveyor belt 3 travelling below a narrow horizontal tobacco channel 2. The upper stretch of the belt 3 travels above a stationary suction chamber **3*a* which attracts particles of the growing tobacco stream while the upper stretch travels toward a transfer station between the belt 3 and a suction wheel 4. A first trimming or equalizing device 3*b* can be mounted in the channel 2 immediately upstream of the transfer station between the belt 3 and suction wheel 4.**

The suction wheel 4 has a circumferential groove the bottom wall of which is perforated and travels around a stationary suction chamber (not shown) so that the stream of tobacco shreds which advance beyond the trimming device **3*b* is automatically transferred into the circumferential groove of the wheel 4 and travels upwardly toward, past and beyond a second or main trimming or equalizing device 6 which converts it into a rod-like filler 7. The filler is thereupon expelled from the groove of the suction wheel 4 by a tongue (not shown) and is attracted to the lower stretch of an endless metallic conveyor belt 9 which travels below a suction chamber 9*a* and serves to transfer the filler 7 onto the upper stretch of an endless conveyor belt 14** known as garniture.

Successive increments of the filler 7 which reach the upper stretch of the garniture 14 actually contact a continuous cigarette paper web 11 which is being drawn from a bobbin 12 and passes through a suitable imprinting mechanism 13 before it reaches the upper stretch of the garniture 14. The latter advances the web 11 through a wrapping mechanism 16 which includes folding instrumentalities serving to convert the web 11 into a tube wherein one marginal portion extends tangentially from the thus confined filler 7. Such marginal portion is coated with adhesive during travel along a paster 17 and is thereupon folded over the other marginal portion to form therewith a longitudinally extending seam. The seam is heated by a sealer 18 so that it is strong enough to withstand the pressure of the confined filler 7. The thus draped web 11 forms with the filler 7 a continuous cigarette rod 19 which passes through a cutoff 21 to be severed at regular intervals while advancing through a tubular guide 22. The resulting discrete plain cigarettes ZX of unit length form a single file wherein the cigarettes travel lengthwise and successive cigarettes of which are accelerated by a rapidly rotating cam 23 so as to be fed into successive flutes of a rotary drum-shaped row forming conveyor 24.

Figure 2:
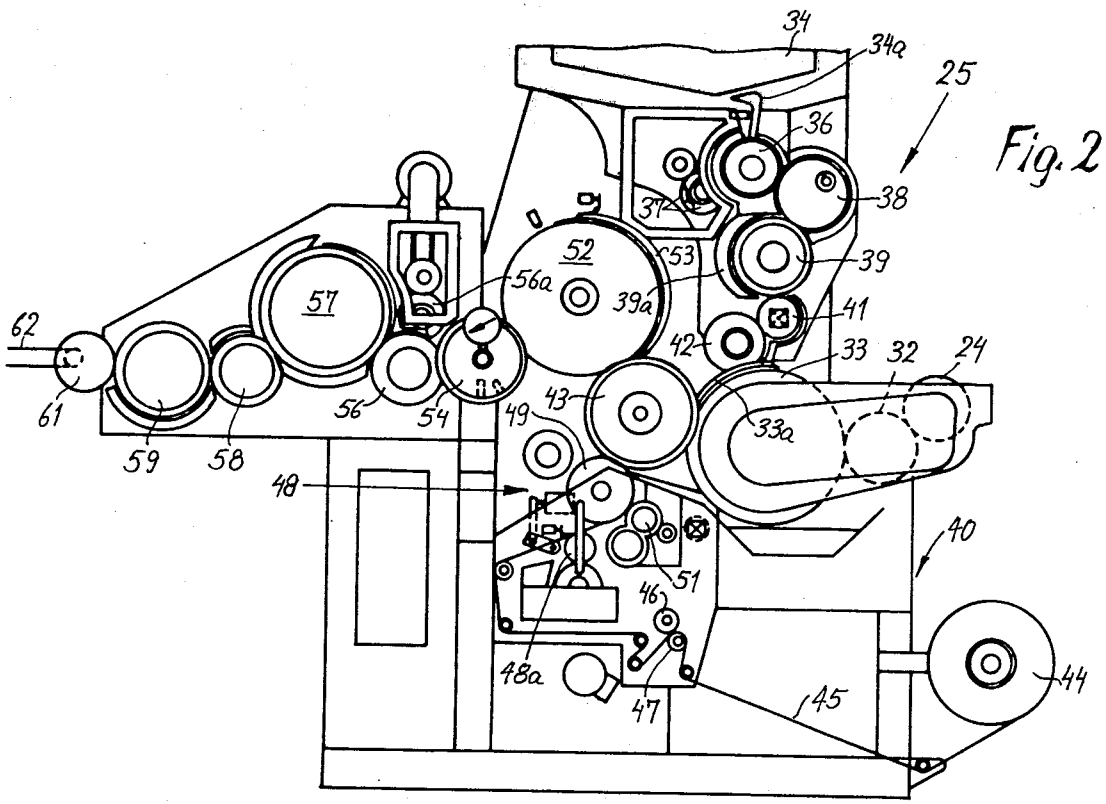
FIG. 2 is a similar view of a second machine which serves to attach sections of filter rods to the wrapped fillers produced by the machine of FIG. 1 and which receives fillers from the conveyor.

FIG. 2 shows a filter cigarette making machine 25 of the type known as MAX, also produced by Hauni-Werke. This machine is directly coupled with the cigarette rod making machine 5 of FIG. 1 (see the row forming conveyor 24 in the right-hand portion of FIG. 2). As will be explained in connection with FIGS. 3 to 5, the conveyor 24 forms two rows of parallel plain cigarettes Z of unit length which travel sideways. This conveyor delivers pairs of parallel cigarettes into successive flutes 32*a* (see FIG. 3 or 5) of an aligning conveyor 32 so that each flute 32*a* contains two spaced-apart coaxial plain cigarettes Z of unit length. This is shown in the lower part of FIG. 3 or 5. The single aligning conveyor 32 can be replaced by two discrete aligning conveyors each of which receives one row of plain cigarettes Z from the row forming conveyor 24. One of the aligning conveyors then travels at a different speed and/or advances the cigarettes of the respective row through a different distance so as to ensure that each cigarette in one of the aligning conveyors is in exact register with a cigarette in the other aligning conveyor not later than at the station where the conveyor or conveyors 32 deliver pairs of coaxial cigarettes Z into successive flutes of an assembly conveyor 33 shown in FIG. 2. The width of the gap between a pair of coaxial cigarettes Z in a flute of the assembly conveyor 33 exceeds the length of a filter rod section of double unit length.

The filter cigarette making machine 25 of FIG. 2 comprises a frame 40 the upper portion of which supports a magazine or hopper 34 having a downwardly extending outlet 34*a*. The magazine 34 is at least partially filled with filter rod sections (not specifically shown) of six times unit length. The outlet 34*a* contains a single row of adjacent parallel filter rod sections of six times unit length and feeds such sections into successive flutes of a severing conveyor 36 which cooperates with two rapidly rotating disk-shaped knives 37 to subdivide each filter rod section of six times unit length into a group of three coaxial filter rod sections of two times unit length.

Each group of three coaxial filter rod sections of double unit length is broken up subsequent to transfer from the severing conveyor 36 onto three staggering conveyors 38 (only one shown in FIG. 2). The conveyors 38 transport the respective filter rod sections of double unit length through different distances and/or at different speeds so as to insure that the filter rod sections are staggered with respect to each other, as considered in the circumferential direction of the staggering conveyor 38 shown in FIG. 2. The conveyors 38 deliver filter rod sections of double unit length into successive flutes of a shuffling conveyor 39 which cooperates with one or more stationary cams 39*a* to shift selected filter rod sections axially so that the filter rod sections form a single row wherein each preceding section is in exact alignment with the next-following section. The filter rod sections of the thus obtained single row are transferred into successive flutes of a transfer conveyor 41 which delivers them into successive flutes of an accelerating conveyor 42. The latter constitutes a means for inserting filter rod sections of double knit length into successive flutes of the assembly conveyor 33 in such a way that each filter rod section of double unit length enters the gap between two coaxial plain cigarettes Z of unit length.

The thus obtained groups of coaxial rod-shaped articles (each group consists of two coaxial plain cigarettes of unit length and a filter rod section of double unit length therebetween) are transferred into successive flutes of a further conveyor 43 which cooperates with a suction drum 49.

The frame 40 of the filter cigarette making machine 25 supports a bobbin 44 for a supply of tape 45 e.g., a web of imitation cork which can be subdivided into discrete uniting bands. As shown in the lower portion of FIG. 2, the tape 45 is being withdrawn from the bobbin 44 by two advancing rolls 46, 47 which transport it in a direction toward the periphery of the suction drum 49. Just before the tape 45 reaches the drum 49, its underside contacts a rotary applicator 48*a* forming part of a paster 48. The latter further includes a tank for a supply of adhesive paste and means for applying a film for adhesive to the applicator 48*a*.

The suction drum 49 cooperates with a rotary knife 51 which severs the leader of the tape 45 at regular intervals so that the tape yields a succession of adhesive-coated uniting bands each of which is attached to a group of rod-shaped articles on the conveyor 43. The manner in which a uniting band is attached to a group is such that the uniting band extends tangentially of the group and contacts the filter rod section of double unit length as well as the adjacent inner end portions of the respective plain cigarettes Z of unit length. The conveyor 43 transfers groups of rod-shaped articles (each such group carries a uniting band) onto a wrapping conveyor 52 which cooperates with a stationary or moving rolling device 53 to rotate the groups around their respective axes whereby the uniting bands are converted into tubes which connect the filter rod sections of double unit length with the respective plain cigarettes so that each group constitutes a filter cigarette of double unit length. It is to be noted here that the assembly conveyor 33 cooperates with one or more stationary cams 33*a* which move one or both plain cigarettes of each group axially toward the other cigarette so as to place the inner ends of the cigarettes into actual abutment with the respective end faces of the filter rod section therebetween.

The wrapping conveyor 52 delivers successive filter cigarettes of double unit length into successive flutes of a rotary drum-shaped conveyor 54 forming part of a first testing unit which monitors the wrappers of successive cigarettes and produces signals in response to detection of defective wrappers. Such signals are utilized to segregate the defective cigarettes from satisfactory cigaretttes, either on the drum 54 or on a severing conveyor 56 which receives tested cigarettes from the conveyor 54 and cooperates with a disk-shaped rotary knife 56*a* to sever each filter cigarette of double unit length midway between its ends so that each such cigarette yields two coaxial filter cigarettes of unit length. Each filter cigarette of unit length consists of a plain cigarette Z, one-half of a filter rod section of double unit length, and one-half of a convoluted tubular uniting band.

Successive pairs of coaxial filter cigarettes of unit length are transferred onto a conveyor 57 forming part of a turn-around device or unit wherein one filter cigarette of each pair is inverted end-for-end and is preferably placed into the spaces between successive non-inverted filter cigarettes of unit length. Thus, all filter cigarettes of unit length form a single row wherein all of the filter tips face in the same direction, and successive cigarettes of this row are transferred onto the conveyor 58 of a second testing unit having means for determining the density of the tobacco-containing ends of filter cigarettes. The second testing unit produces signals in response to detection of cigarettes wherein the density of tobacco-containing ends is unsatisfactory, and such signals are utilized for segregation of defective cigarettes from satisfactory cigarettes. The conveyor 58 is followed by a further conveyor 59 and a conveyor 61 which transfers the satisfactory filter cigarettes of unit length onto the upper stretch of an endless conveyor belt 62. This belt can transport satisfactory filter cigarettes of unit length into storage, to a tray filling machine (not shown), or directly to a packing machine (not shown).

If desired, the conveyor 58 of FIG. 2 may constitute a simple transfer conveyor and the conveyor 59 then forms part of the aforementioned second testing unit.

The machines 5 and 25 of FIGS. 1 and 2 constitute the first and second machines of a complete production line or apparatus which may further comprise a third machine for conditioning tobacco shreds prior to introduction of shreads into the magazine of the distributor 1, a fourth machine for the production of filter rod sections, a fifth machine for transporting filter rod sections from the fourth machine into the magazine 34 of the machine 25, a sixth machine which forms soft or flip-top packs and introduces arrays of filter cigarettes into such packs, a seventh machine for applying transparent outer envelopes with tear strips and revenue labels to the packs produced by the sixth machine, and an eighth machine which introduces packs having revenue labels into cartons or the like.

Figures 3, 5:
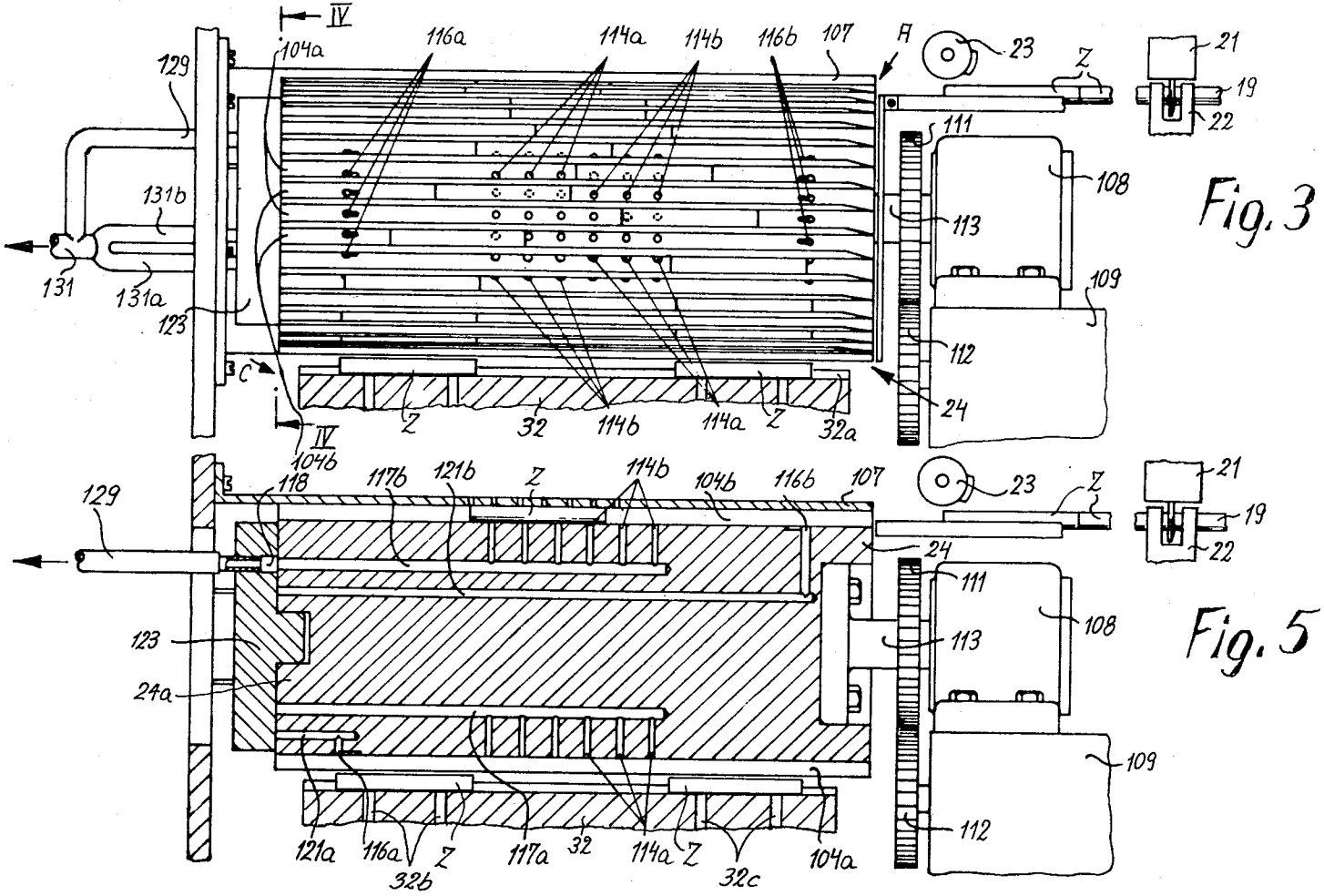
FIG. 3 is an enlarged elevational view of the conveyor.
FIG. 5 is a sectional view of the conveyor as seen in the direction of arrows from the line V—V of FIG. 4.
Figure 4:
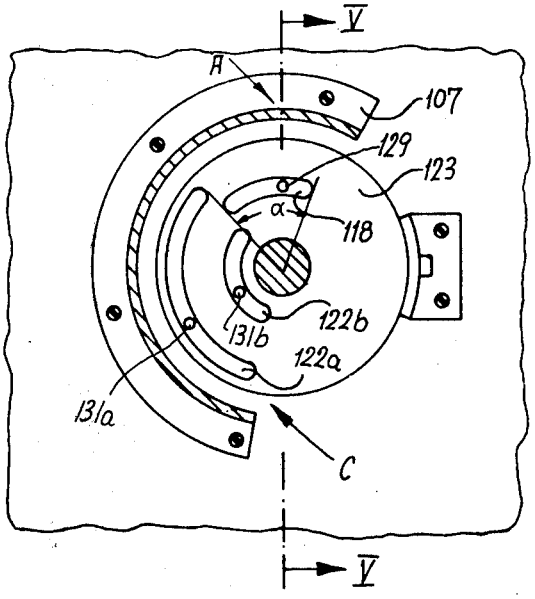
FIG. 4 is a sectional view as seen in the direction of arrows from the line IV—IV of FIG. 3.

FIGS. 3 to 5 illustrate the details of the row forming conveyor 24. This conveyor comprises a drum-shaped body 24*a* mounted on a shaft 113 which is rotatable in a bearing 108. The shaft 113 is rigid with a gear 111 in mesh with a second gear 112 which is rotated by a transmission 109 receiving motion from the main prime mover of the cigarette rod making machine 5. The periphery of the drum 24*a* is formed with alternating parallel flutes 104*a* and 104*b* which travel seriatim past a station A where the accelerating cam 23 feeds cigarettes Z lengthwise into successive flutes. That portion of the periphery of the drum 24*a* which is adjacent to the station A is surrounded by an arcuate shroud 107 which preferably consists of transparent or translucent synthetic plastic material and is sufficiently close to the periphery of the drum 24*a* to substantially seal the flutes 104*a* and 104*b* therebelow against entry of excessive amounts of atmospheric air. Each flute 104*a* communicates with three radially inwardly extending suction ports 114*a,* and each flute 104*b* communicates with three radially inwardly extending suction ports 114*b.* The flutes 104*a* further communicate with single suction ports 116*a,* and the flutes 104*b* further communicate with single suction ports 116*b.* The suction ports 114*a* and 114*b* are disposed substantially centrally of the drum 24*a,* the ports 116*a* are adjacent to that end of the drum 24*a* which is remote from the station A, and the ports 116*b* are nearest to the station A. The ports 114*a* and 114*b* serve to brake the cigarettes Z which enter the respective flutes 104*a,* 104*b* and the ports 116*a* and 116*b* serve to shift the cigarettes Z in the respective flutes to predetermined axial positions so that the cigarettes which travel sideways with the drum 24*a* form two discrete rows as shown in the lower portion of FIG. 3 or 5.

The left-hand end face of the drum 24*a* is adjacent to a stationary valve plate 123 (shown in detail in FIG. 4) which is formed with three arcuate suction grooves 118, 122*a,* 122*b.* The suction ports 114*a* and 114*b* respectively communicate with discrete suction channels 117*a.* 117*b* which are machined into the drum 24*a* and extend in parallelism with the shaft 113. The channels 117*a* and 117*b* are blind bores having open ends adjacent to the valve plate 123 and communicating seriatim with the arcuate groove 118. The suction ports 116*a* communicate with relatively short suction channels 121*a* which are machined into the drum 24*a* and communicate seriatim with the groove 122*a* of the valve plate 123. The suction ports 116*b* communicate with discrete suction channels 121*b* in the drum 24*a,* and the open ends of the channels 121*b* communicate with the groove 122*b* of the valve plate 123 during a certain portion of each revolution of the drum 24*a* about the axis of the shaft 113. The grooves 118, 122*a,* 122*b* of the valve plate 123 communicate with a suction pipe 131 which is connected to a suction generating device 149 shown in FIG. 6. As shown in FIG. 3, the suction pipe 131 has three branches 129, 131*a,* 131*b* which are respectively connected to the grooves 118, 122*a,* 122*b* of the valve plate 123. The cigarettes Z in the flutes 104*a,* 104*b* of the conveyor 24 move sideways.

Referring to FIG. 4, the drum 24*a* is assumed to rotate in a counterclockwise direction. It will be noted that the groove 118 of the valve plate 123 extends along an arc alpha and that the grooves 122*a,* 122*b* begin where the groove 118 ends. The grooves 122*a,* 122*b* end at a transfer station C where the cigarettes Z are transferred into the flutes 32*a* of the aligning conveyor 32 forming part of the filter cigarette making machine 25. The conveyor 24 can be said to form part of the machine 5 or 25.

The operation of the row forming conveyor 24 of FIGS. 3 to 5 is as follows:

The cutoff 21 cooperates with the guide 22 to sever the continuous cigarette rod 19 at regular intervals so that the rod yields a single file of plain cigarettes or wrapped rod-like tobacco filler sections Z of unit length. Such cigarettes advance into the range of the accelerating cam 23 which propels them into successive flutes 104*a,* 104*b* of the drum 24*a* at the station A. The entry of cigarettes Z into the respective flutes is assisted by suction because the flutes 104*a* and 104*b* which approach and travel past the station A are overlapped by the shroud 107 which seals these flutes against entry of atmospheric air or at least reduces the amount of atmospheric air which can enter the flutes while the flutes receive discrete cigarettes Z. The shaft 113 rotates the drum 24*a* in synchronism with the moving parts of the machine 5 so that the cam 23 can propel successive cigarettes Z into successive flutes 104*a* and 104*b.* The suction ports 114*a* or 114*b* of that flute 104*a* or 104*b* which is in the process of receiving a cigarette Z communicate with the groove 118 of the stationary valve plate 123 because the respective suction channels 117*a,* 117*b* then travel along the groove 118 and toward the adjacent front ends of the grooves 122*a,* 122*b.* Consequently, the respective ports 116*a,* 116*b* are disconnected from the suction generating device 149 while the cigarettes Z are being admitted into the flutes 104*a* and 104*b.* This enables the ports 114*a* or 114*b* to arrest the respective cigarettes Z substantially centrally of the respective flutes. The stoppage of cigarettes Z under the action of suction in the ports 114*a* and 114*b* is such that the exact axial positions of cigarettes cannot be defined with a sufficient degree of accuracy. Therefore, as soon as a flute 104*a* or 104*b* which has advanced beyond the station A covers the angle alpha shown in FIG. 4, the corresponding suction channel 121*a* or 121*b* beings to communicate with the groove 122*a* or 122*b* whereby the respective port 116*a* or 116*b* attracts and shifts the cigarette Z in the respective flute 104*a* or 104*b* so that the cigarettes from two discrete rows wherein each preceding cigarette is at least substantially aligned with the next-following cigarette. The suction ports 114*a*, 114*b* cease to attract the cigarettes Z when the corresponding suction ports 116*a*, 116*b*are in communication with the grooves 122*a*, 122*b*.

It will be seen that the suction ports 116*a* cause the cigarettes Z in the respective flutes 104*a* to advance further in the original direction, i.e., away from the station A. On the other hand, the suction ports 116*b* in the flutes 104*b* cause the corresponding cigarettes Z to reverse the direction of their movement and to travel toward the right-hand end of the drum 24*a*, as viewed in FIG. 3 or 5. As stated before, the grooves 122*a*, 122*b* terminate at the station C where the cigarettes Z can descend into the flutes 32*a* of the aligning conveyor 32 under the action of gravity as well as under the action of suction in the ports 32*b*, 32*c* shown in FIGS. 3 and 5.

Since a cigarette rod making or filter cigarette making machine turns out large quantities of rod-shaped articles per unit of time (presently up to and in excess of 4,000 per minute), the cigarettes are likely to lose reusable tobacco shreds and/or tobacco dust, for example, during introduction into the flutes 104*a*, 104*b* of the row forming conveyor 24 (especially if such flutes are additionally provided with mechanical stops for the cigarettes Z or if the mechanical stops replace the suction ports 114*a*, 114*b*, 116*a*, 116*b* shown in FIGS. 3 and 5). Also, plain cigarettes Z are likely to lose tobacco shreds and/or dust during transport from the conveyor 24 toward the belt 62 of FIG. 2, e.g., during travel with the conveyor 54 of the first testing unit, during travel with the conveyor 57 of the turn-around unit, and/or during travel with the conveyor 58 or 59 of the second testing unit in the machine 25.

Figure 6:
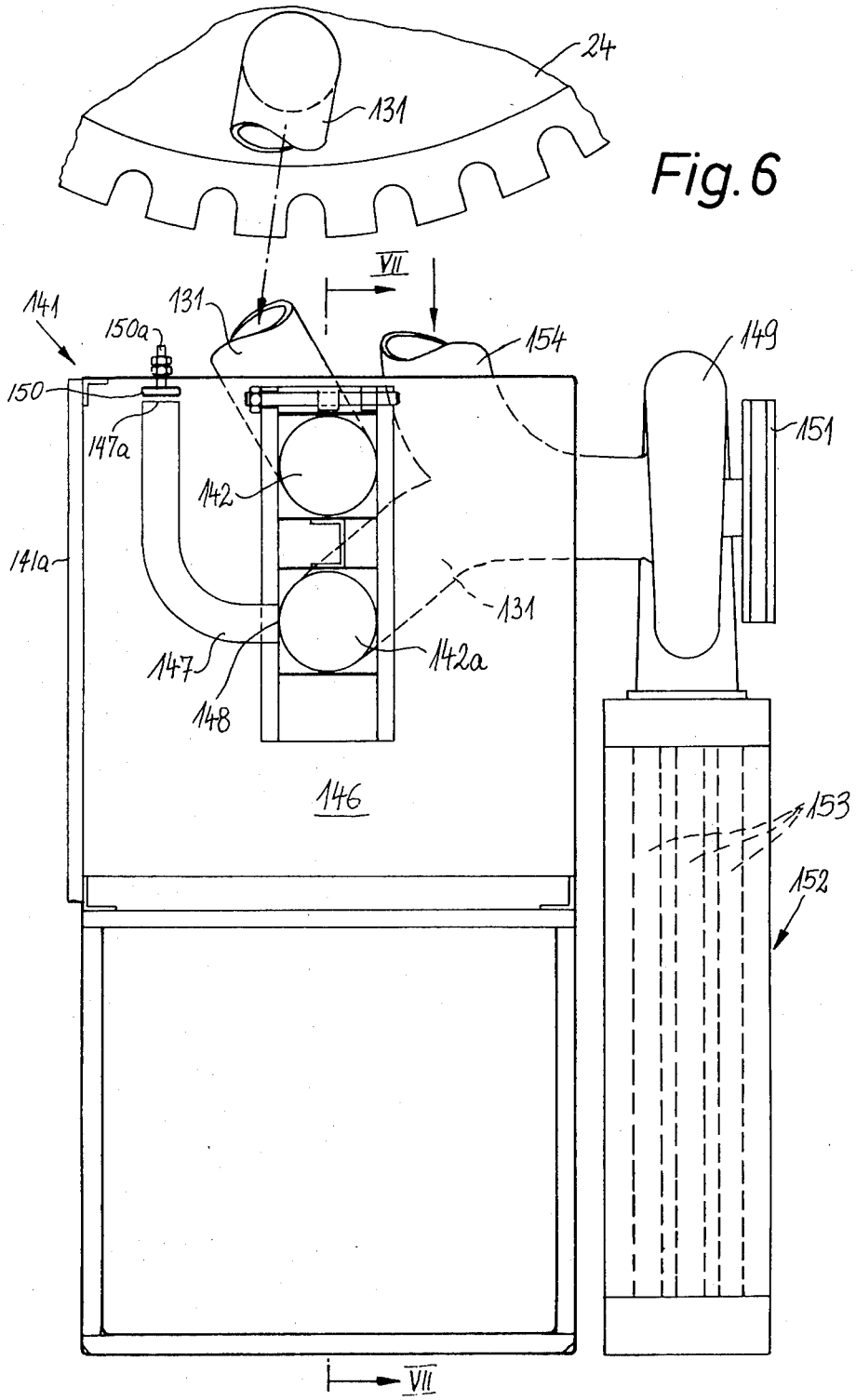
FIG. 6 is an elevational view of a separator which serves to segregate reusable tobacco particles from the air stream which is used to hold wrapped fillers on the conveyor of FIG. 3.
Figure 7:
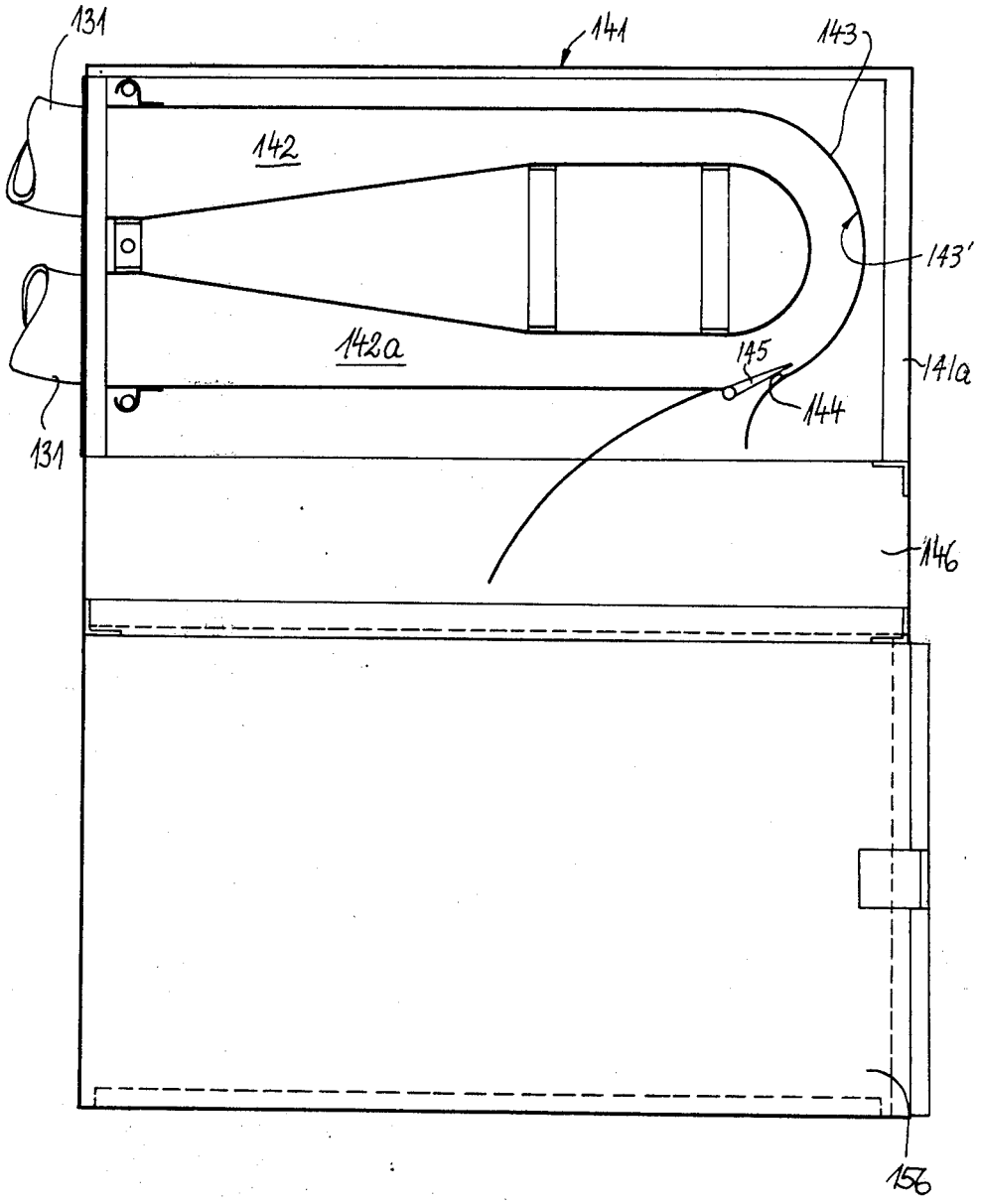
FIG. 7 is a schematic sectional view of the separator as seen in the direction of arrows from the line VII—VII of FIG. 6.

Referring now to FIGS. 6 and 7, the suction pipe 131 which draws air from the grooves 118, 122*a* and 122*b* of the valve plate 123 normally contains and transports minute and/or larger reusable particles of tobacco which must be segregated from the air stream, not only because the air stream is normally recirculated to be used as compressed air in certain units of a production line for cigarette packs but also because the particles of tobacco should be recycled for the making of rod-like tobacco fillers (see the filler 7 in FIG. 1). In accordance with a feature of the invention, the segregation of solid particles from the air stream in the suction pipe 131 is carried out in two stages including a first stage upstream of the suction generating device 149 and a second stage downstream of the device 149. The first stage of segregation is performed by a separator 141 which is shown in FIGS. 6 and 7. The suction pipe 131 extends into the upper portion of the housing 141*a* of this separator to form therein a relatively long bend including an air-admitting first section 142, an arcuate intermidiate or tobacco removing section 143 and an air-discharging third section 142*a* which may but need not be substantially parallel to the first section 142. The internal surface of the section 143 has a concave portion 143' which merges into the adjoining portion of the internal surface of the third section 142*a*. That part of the concave surface portion 143' which is immediately or closely adjacent to the section 142*a* is formed with an outlet opening 144 for evacuation of solid particles. During travel in the section 143, solid tobacco particles (including dust, shreds and fragments of ribs and/or stem) tend to slide along the surface portion 143' under the action of centrifugal force so that they leave the section 143 and descend into a collecting receptacle 146 below the section 142*a*. The effective size of the outlet opening 144 can be regulated by a pivotable flap 145 which can be adjusted from without the housing 141*a* and whose angular position is preferably observable by looking through a window (not shown) in the housing of the separator 141.

A pressure equalizing conduit 147 connects the interior of the collecting receptacle 146 with the section 142*a*, as at 148, i.e., at a locus where the suction is quite pronounced because of the proximity to the suction generating device 149. The open intake end 147*a* of the pressure equalizing conduit 147 is adjacent to an adjustable damper 150 which controls the rate of air flow from the receptacle 146 into the section 142*a*. As shown, the shank 150*a* of the damper extends upwardly from and is accessible at the top of the housing 141*a*. The latter has a door 156 which can be opened to permit evacuation of accumulated solid particles and their transfer into a magazine, for example, into the magazine of the distributor 1 shown in FIG. 1.

The foremost part of the suction pipe 131 (i.e., that part which receives air from the section 142*a*) is connected with the air intake of the suction generating device 149 (e.g., a suitable suction fan whose impeller is driven by a motor, not shown, through the medium of a pulley 151). The pressure outlet of the suction generator 149 is connected with a main segregating device 152 which removes the remaining solid particles from the air stream supplied by the pipe 131 as well as from one or more additional pipes which together form a second pipe 154 communicating with the pipe 131 immediately upstream of the suction generating device 149, i.e., downstream of the secondary or additional segregating device including the separator 141. For example, the pipe 154 can supply to the device 149 all such air streams which are used in the machine 25 of FIG. 2 to assist in the transfer of filter rod sections, plain cigarettes, groups of filter rod sections and plain cigarettes as well as filter cigarettes of double unit length and filter cigarettes of unit length from conveyor to conveyor and to hold such rod-shaped articles in the flutes of the conveyors on their way friom the magazine 34 and conveyor 24 to the assembly conveyor 33 and thereupon from the conveyor 33 to the belt 62. Also, the pipe 254 can supply air streams which are used to attract the leader of the tape 45 to the suction drum 49.

The main segregating device 152 may comprise several flexible hoses 153 to filter material which permits the passage of air but intercepts all or nearly all solid particles. The cleaned air can be discharged into the atmosphere or used in certain parts of the machine 5 and/or 25, for example, for ejection of cigarettes which have been found to be defective by the testing units including the conveyors 54 and 58 or 59 of FIG. 2. The segregating device 152 is preferably mounted on the frame 40 of the machine 25 but it can also be mounted on the frame of the machine 5 of FIG. 1. It is equally possible to provide a discrete main segregating device 152 for each of the machines 5, 25 and to fuether provide a discrete separator 141 for each of these machines. As shown in FIG. 1, the housing of the separator 141 can be mounted on top of the distributor 1 and the lower portion of the receptacle 146 can discharge solid particles into an air lock 157 for direct transfer into the magazine of the distributor. If desired, the contents of the receptacle 146 can be fed directly into the tobacco channel 2 of FIG. 1.

Still further, a main segregating device may be used to remove solid particles from air streams which are being supplied by an entire battery of cigarette rod making and/or filter cigarette making machines. For example, a single segregating device 152 can be designed to receive air streams from a large number of filter cigarette making machines or from a large number of machines of the type shown in FIG. 1. Also, the main segregating device can be installed in the pipe 131 of FIGS. 6 and 7 upstream of the suction generating device 149.

The hoses 153 of the conventional main segregating device 152 preferably consist of textile or like filtering material having a fine mesh so as to intercept the smaller and smallest solids before the solids are permitted to enter the surrounding atmosphere. Such filtering materials are likely to be clogged at frequent intervals and their cleaning or replacement takes up a substantial amount of time. It has been found that the separator 141 is capable of intercepting a high percentage of solids in the air stream flowing through the pipe 131 so that the main segregating device 152 is relieved and requires less frequent cleaning amd/or replacement or filters. Another advantage of the separator 141 is that it does not offer a pronounced resistance to the flow of suction air therethrough so that the energy requirements of the suction generating device 149 are not increased at all or are increased only negligibly as a result of the provision of separator 141.

It is clear that the improved separator can be used with equal advantage in machines or groups of machines for the making of cigarillos or cigars with or without filter tips, especially for the making of filter tipped cigars.

The advantages of recycling all or nearly all reusable tobacco particles will be readily appreciated by considering that a single machine can produce up to and in excess of 3,000,000 cigarettes per day. Thus, even if the quantity of tobacco which escapes from a single plain cigarette or a single filter cigarette is extremely small, the combined quantity of tobacco particles is substantial and warrants the provision of effective means for intercepting and recycling such particles, especially in view of the continuously rising cost of tobacco.

The operation of the segregating device including the separator 141 and of the segregating device 152 of FIGS. 6–7 is as follows:

The branches 129, 131*a*, 131*b* draw air streams from the grooves 118, 122*a*, 122*b* of the valve plate 123, and such air streams merge to form a single air stream which passes through the pipe 131 and its sections 142, 143, 142*a* in the upper part of the housing 141*a*. This results in removal of a substantial percentage of solid particles which leave the section 143 via outlet opening 144 and descend into the receptacle 146. That portion of the air stream which leaves the section 143 via opening 144 is caused or permitted to flow into the section 142*a* via pressure equalizing conduit 147. The provision of this conduit is desirable in order to prevent an undue rise of air pressure in the receptacle 146; this would interfere with rapid deposition of solid particles in the lower portion of the receptacle.

The partially cleaned air stream leaves the section 142*a* and flows in the pipe 131 toward and into the inlet of the suction generating device 149. Prior to reaching the device 149, the air stream in the pipe 131 merges with the air stream which is supplied by the second pipe 154. The air stream leaving the suction generating device 149 enters the main segregating device 152 and is relieved of the remaining solid particles which are intercepted by the air-permeable filtering hoses 153. As shown in FIG. 1, at least the receptacle 146 of the separator 141 can be mounted at a level above the machine 5 so that solid particles can be returned into the distributor 1 via air lock 156.

Figure 8:
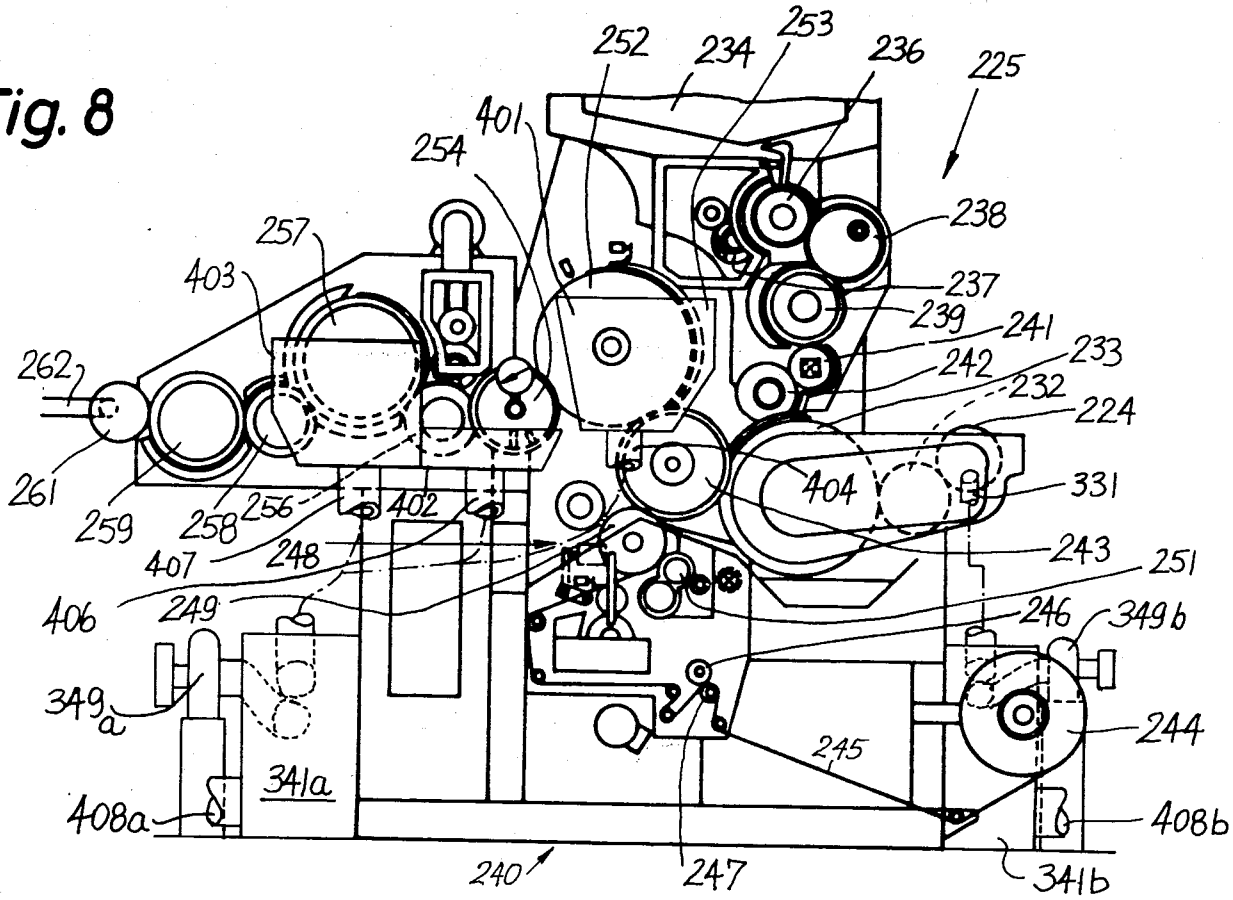
FIG. 8 is an elevational view of a machine which constitutes a first modification of the machine of FIG. 2 and is combined with two discrete separators for resusable tobacco particles.

FIG. 8 illustrates a filter cigarette making machine 225 wherein all such parts which are identical with or clearly analogous to the corresponding parts of the machine 25 are denoted by similar reference characters plus 200. The main difference is that the frame 240 of the machine 225 supports several collecting vessels or trays which are disposed at locations most likely to be contaminated by descending reusable tobacco particles and/or dust. For example, a first vessel or tray 401 can be placed below a portion of or the entire wrapping unit including the conveyor 252 whereon the cigarettes are caused to roll about their own axes and are thus likely to discharge tobacco shreds and/or dust. A second tray or vessel 402 is mounted below the conveyor 254 of the first testing unit, and a third tray or vessel 403 is placed below the turn-around unit 257. At the first testing station (conveyor 254), the cigarettes are likely to lose tobacco particles because their wrapper are normally tested by streams of a gaseous fluid which is prone to entrain some loose particles. At the inverting station, filter cigarettes of unit length can lose tobacco shreds because one cigarette of each pair is turned around end-for-end and is therefore likely to discharge solid particles under the action of centrifugal force.

The lower portions of the vessels 401, 402, 403 respectively communicate with suction pipes 404, 406, 407 which are connected with a common separator 341*a*. The fan 349*a* of the separator 341*a* causes the air streams to flow from the vessels 401–403 into the separator 341*a*.

The suction pipe 331 which draws air from the grooves of the valve plate (not shown) associated with the drum of the row forming conveyor 224 of FIG. 8 admits a stream of air and tobacco particles into a discrete second separator 341*b* which includes a fan 349*b*. The conveyor 224 can be said to constitute a unit of the machine 225 or of the machine which supplies plain cigarettes to the machine 225. FIG. 8 further shows tubes 408*a* and 408*b* which respectivey serve to transport separated solid particles from the receptacles of the separators 341*a*, 341*b* to a station where such particles are reused, e.g., into the magazine of a distributor corresponding to the distributor 1 of the machine 5 shown in FIG. 1.

The machine of FIG. 8 can be modified in a number of ways. For example, the separator 341*b* can be omitted if the suction pipe 331 is connected to the inlet of the fan 349*a*. Also, the segregating means can comprise four discrete separators, one for solid particles which are being conveyed by the pipe 331 and one for each of the pipes 404, 406, 407. Still further, the segregating means may comprise two or three separators; in the first instance, the fan of one of the separators is connected with the pipe 331 and with one of the pipes 404, 406, 407 and the fan of the other separator is connected with the other two of the pipes 404, 406, 407. If the segregating means comprises three separators, one thereof can be connected with the pipe 331 and with one of the pipes 404, 406, 407, another with one of the remaining two pipes, and the third with the other of the two remaining pipes.

Figure 9:
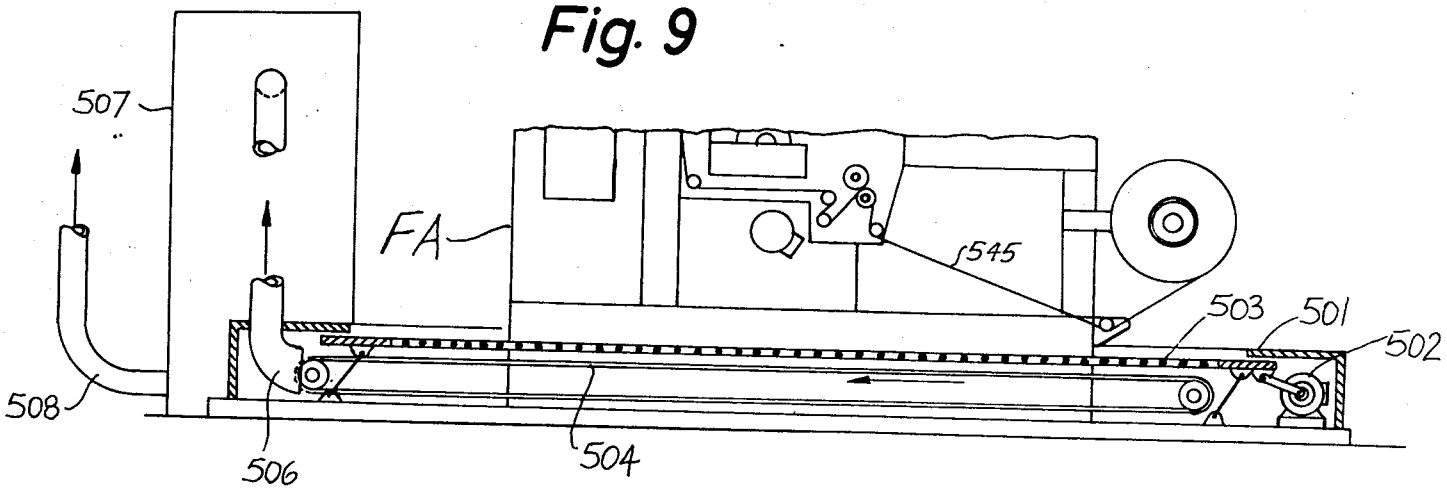
FIG. 9 is a fragmentary partly elevational and partly sectional view of a machine which constitutes a second modification of the machine shown in FIG. 2 and is combined with a single separator for reusable tobacco particles.

FIG. 9 shows the lower portion of a filter cigarette making machine FA which is similar to the machine 25 of FIG. 2 or the machine 225 of FIG. 8. In contrast to the machine of FIG. 8, the machine of FIG. 9 comprises a single vessel 501 which is disposed below all units of the machine FA (i.e., below the path of movement of plain cigarettes, filter rod sections, groups of plain cigarettes and filter rod sections, filter cigarettes of double unit length and filter cigarettes of unit length). The vessel 501 is open at its top and its opening is located above a sieve 503 which is vibrated by a motor 502 through the medium of an eccentric and serves to intercept descending filter rod sections, plain or filter cigarettes and/or sections of the tape 545. The particles of tobacco pass through the interstices of the sieve 503 and descend onto the upper stretch of an endless conveyor belt 504 which is mounted in the vessel 501 and serves to transport intercepted tobacco particles to the inlet of a suction pipe 506 corresponding to the pipe 131 of FIGS. 6 and 7. This pipe admits a mixture of air and tobacco particles into a separator 507 which can be similar to the separator 141 and discharges separated tobacco particles into a tube 508 for transport to the magazine of the distributor (not shown) of a cigarette rod making machine.

An advantage of the structure of FIG. 9 is that a segregating means including a single separator 507 suffices to collect all loose tobacco particles and/or tobacco dust and that such collection takes place simultaneously with segregation of tobacco particles from larger commodities, such as fragments of or complete filter rod sections and fragments of or complete plain cigarettes. The larger commodities which are intercepted by the sieve 503 can be removed by hand or automatically in a manner not forming part of the invention, e.g., by resorting to a rake which is caused to pass above the sieve at predetermined or irregular intervals.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

1. In an apparatus for the manufacture and processing of smokers' products wherein wrapped rod-like tobacco fillers are transported by conveyors along at least one predetermined path and/or otherwise manipulated at a plurality of stations, wherein the transport and manipulation of wrapped fillers is effected at least in part by at least one stream of air with attendant unpredictable entry of tobacco particles from the wrapped fillers into the stream, and wherein at least some particles of tobacco are removed from the air stream during passage of the stream through a first segregating means, the improvement which consists in the provision of additional segregating means including at least one separator having means for admitting the air stream ahead of said first segregating means, means for removing at least some tobacco particles from the thus admitted stream, and means for guiding the stream from said separator to said first segregating means.

2. The improvement as defined in claim 1, wherein said first segregating means includes a suction generating device and said stream guiding means of said separator is connected to said suction generating device.

3. The improvement as defined in claim 1, wherein said apparatus includes a machine for the making of wrapped fillers and one of said conveyors includes means for receiving fillers from said machine and for transporting the fillers along a portion of said path, and means for retaining the fillers in said receiving means by suction, said stream admitting means of said separator forming part of a suction pipe which is connected to said retaining means.

4. The improvement as defined in claim 3, wherein said machine includes means for feeding wrapped fillers to said one conveyor along a second portion of said path in which the fillers move lengthwise and said receiving means of said one conveyor move the fillers sideways.

5. The improvement as defined in claim 1, wherein said apparatus comprises at least one magazine for tobacco particles and further comprising means for transferring removed tobacco particles from said separator into said magazine.

6. The improvement as defined in claim 1, wherein said apparatus is a production line having a first machine for the production of wrapped tobacco fillers and a second machine for attachment of filter rod sections to the wrapped fillers produced by said first machine.

7. The improvement as defined in claim 6, wherein said stream admitting means of said separator forms part of at least one pipe receiving a first stream of air from said first machine and at least one second pipe receiving a second stream of air from said second machine.

8. The improvement as defined in claim 1, wherein said separator comprises a pipe having a first section constituting said stream admitting means, a second section constituting said stream guiding means and a third section disposed between said first and second sections and constituting said removing means, said third section being of arcuate shape and having an opening through which tobacco particles leave said pipe under the action of centrifugal force.

9. The improvement as defined in claim 8, wherein said separator further comprises a receptacle positioned to receive tobacco particles from said opening whereby a portion of the air stream leaves said pipe via said opening, said separator further comprising pressure equalizing conduit means connecting the interior of said receptacle with said pipe.

10. The improvement as defined in claim 9, wherein said opening is located in the region where said third section admits said stream into said second section of said pipe.

11. The improvement as defined in claim 9, wherein said conduit means connects the interior of said receptacle with said second section of said pipe.

12. The improvement as defined in claim 1, wherein said first segregating means comprises at least one filter through which said stream is free to pass but which intercepts the remaining tobacco particles in said stream.

13. The improvement as defined in claim 1, wherein one of said conveyors is a rotary drum-shaped conveyor having a peripheral surface provided with axially parallel flutes and suction ports communicating with said flutes, said stream admitting means being connected with said ports.

* * * * *